United States Patent [19]

Seymour

[11] 4,207,141

[45] Jun. 10, 1980

[54] PROCESS FOR CONTROLLING PULP WASHING SYSTEMS

[76] Inventor: George W. Seymour, 2841 Parkwood Dr., Brunswick, Ga. 31520

[21] Appl. No.: 904,360

[22] Filed: May 9, 1978

[51] Int. Cl.[2] ..... D21C 9/02; D21C 9/06

[52] U.S. Cl. ..... 162/49; 8/156; 162/60; 162/252; 162/258; 162/263

[58] Field of Search ..... 162/49, 60, DIG. 10, 162/198, 263, 252, 258; 324/61 R; 8/156, 158; 68/181 R; 364/510, 471

[56] References Cited

U.S. PATENT DOCUMENTS

| | | | |
|---|---|---|---|
| 1,886,508 | 11/1932 | Wierk | 162/263 |
| 3,046,479 | 7/1962 | Mead et al. | 324/61 R |
| 3,586,972 | 6/1971 | Tulleners | 324/61 R |
| 3,704,412 | 11/1972 | Lundstrom | 324/61 R |
| 4,096,028 | 6/1978 | Rosenberger | 162/DIG. 10 |
| 4,104,114 | 8/1978 | Rowlandson et al. | 162/60 |
| 4,138,313 | 2/1979 | Hillstrum et al. | 162/49 |

FOREIGN PATENT DOCUMENTS 993541 7/1976 Canada .

*Primary Examiner*—S. Leon Bashore
*Assistant Examiner*—Steve Alvo
*Attorney, Agent, or Firm*—Jones, Tullar & Cooper

[57] ABSTRACT

A method of controlling the amount of a liquid shower flow introduced onto a slurry mat such as a pulp mat which is undergoing incomplete liquid separation on a vacuum filter drum. The flow rate of the liquid being discharged with the slurry mat is determined by a capacitance measurement which is taken after the slurry mat has passed to a point on the filter means where liquid separation no longer occurs. The shower flow is controlled by a correlation of the flow rate of the liquid in the slurry mat with the rate of slurry mat transfer from the vacuum filter drum and the necessary liquid shower flow as expressed by a dilution factor.

The present control system may be combined with secondary apparatus to measure the flow rate and thickness of the total slurry mat in order to determine by correlation the slurry mat consistency, the rate of solid material production from the slurry mat and the amount of air contained in the slurry mat.

14 Claims, 5 Drawing Figures

PROCESS FOR CONTROLLING PULP WASHING SYSTEMS

BACKGROUND OF THE INVENTION

1. Field of the Invention

The present invention relates to a method of controlling the amount of water which is added into a pulp washing system by monitoring the amount of water in a washed pulp mat leaving the pulp washing system.

2. Description of the Prior Art

Pollution control depends upon the washing operation control whereby if there is insufficient wash water added to the system the washing step is inefficient and increases the pollution.

Poor control can also be in the other direction whereby an excessive amount of wash water is applied and this excess water must be evaporated in the evaporator operation which then causes an excessive energy consumption.

Washing control systems presently in use do not use the water efficiently in that for short periods of time there is an excess of water used followed by a period whereby an insufficient amount is used. This leads to insufficiencies of both kinds described above within the one continuous washing system.

Pulp washing systems are designed to minimize the amount of fresh water needed to wash the black liquor from the pulp produced from a pulp digester. Countercurrent pulp washing techniques are almost exclusively used in order to increase efficiency in the pulp washing system. In conventional countercurrent washing operations, fresh water which is added to the system is generally referred to as shower water because it is sprayed as a shower upon a pulp mat which has been formed in the last of a number of washing operations.

Two important factors which must be understood with relation to the present washing control system are the dilution factor and the displacement factor. These factors influence the determination of the flow rate of shower water as calculated by the present control system and must necessarily be appreciated to enable the control system to permit a satisfactory pulp washing operation.

The dilution factor represents a ratio of the amount of fresh water sprayed onto a pulp mat undergoing a washing operation to the final volume of water contained in the pulp mat as it leaves the washing operation. The amount of fresh water entering the washing system may be expressed in appropriate flow rate units such as liters per minute. The volume of water leaving the washing system in the final washed pulp mat product is expressed in the same units. In countercurrent washing operations recycled water is sprayed on the pulp mat in all but the final washing operation. The dilution factor for each washing operation step prior to the final fresh water treatment is expressed as the ratio of the recycled water sprayed onto the pulp mat to the volume of water contained in the pulp mat which has been treated in the individual washing step.

The displacement ratio is equal to the fractional of the liquor entering the filter drum in the pulp mat which is displaced by water from the spray washer. The ideal displacement ratio would be 1.0 where ideal plug flow existed; however, the ideal situation is not obtained. The displacement factor is primarily a function of the dilution factor but is influenced by such factors as air entrainment in the pulp web, pulp web sheet uniformity, and the temperature of the system. The displacement factor can be determined by an analysis of the amount of dissolved solids which remain in the pulp after washing compared to the dissolved solids which would be in the pulp at the same consistency without any shower flow. In effect, this displacement ratio may be displayed by a comparison between the dissolved solids concentration in the water in the pulp mat exiting the washing system after the washing treatment, and the dissolved solids concentration of the pulp before the final shower water treatment.

While the use of countercurrent washing systems reduces the amount of fresh water which is needed in a pulp washing system, previous attempts to minimize the total amount of fresh shower water introduced into the wash system have proved to be inefficient. Previous systems have not provided for a continuous monitorization and immediate shower flow response to produce a pulp washing system which is continuously efficient in minimizing the shower flow necessary to produce a satisfactorily washed pulp product. The present invention overcomes the deficiencies of the control methods used in the past.

Primarily, two control methods have been used to control pulp washing systems in the past. In the first method a pulp flow rate on the entire set of washers is estimated to be constant and the pulp flow rate is calculated for one washer by correlating a flow measurement and a consistency. The consistency of the pulp leaving the washer drums is not taken into account except in the design of the system. The shower water flow on the last washer is then set by the operator based on hourly tests of the solids content of the liquor in the early stages of the washing operation. The system can be out of balance in both of the ways previously described several times during the hour without detection by the operator. The average liquor solids content can be on target yet the system can be inefficient in producing both high losses to the sewer and excessive water to be evaporated. This can be explained by showing that an overwash for part of the time cannot make up for an insufficient wash the other part of the time.

In the second prior art control method as described in U.S. Pat. No. 4,046,621 to Sexton, the conductivity of the liquid displaced from the pulp mat in the last washing step is measured and this measurement is used to adjust the amount of fresh washing liquid in the last washing stage.

This system is an improvement over the operator control alone but has several disadvantages. The first disadvantage is that conductivity is not precisely related to the liquor solids content as it is greatly influenced by the composition of the solids. Secondly, the large volumes of liquor circulated in the wash system have a large buffering action on the rate of change of liquor conductivity with a change in washing efficiency. In a typical pulp washing system operation at 500 metric tons of pulp per day the liquor volume maintained in each stage filtrate tank will be in the order of 200,000 liters which is recirculated in the wash system at a rate of about 30,000 liters per minute. The shower flow for 1.15 dilution factor would be 2928 liters per minute at 12 percent discharge consistency. Of this 2928 liters per minute approximately 382 liters per minute would penetrate the mat with a perfect displacement system. In a normal balanced system this 382 liters per minute would be mixing continuously with the 200,000 liters in the filtrate tank.

If the shower flow was accidently cut completely off the conductivity system of control would detect a rate of change of only $(100 \times 382/200{,}000) = 0.19$ percent per minute. This small change in conductivity would not initiate a change in the shower set point until significant inefficiencies in the system had occurred.

SUMMARY OF THE INVENTION

This invention overcomes the problem of the prior art by providing a continuous monitorization system which is used to immediately control the shower flow of fresh water or liquid additives which is introduced into a pulp washing system. Through the use of a monitorization system featuring immediate response in the shower flow control greater efficiency is produced in regulating the shower flow necessary to produce an acceptable washed pulp product. This improvement over the prior wash control processes alleviates the problems produced by wash systems using too much shower water flow, thereby causing excess water to be sent to the evaporators, and by wash systems using too little shower water flow, thereby producing pulp which has not been sufficiently washed creating high pollution loads and economic loss of chemicals from the process.

The foregoing advantages are obtained by the present invention by a process which determines the amount of water content present in a pulp web using a capacitance measurement technique after the web passes over a vacuum break on a rotary drum vacuum filter which is the final step before removal of the pulp in the form of a mat or a web from the washing system. Once the water content of the pulp mat is determined, it may be correlated to control the fresh water shower flow rate, thus minimizing the amount of fresh water needed to satisfactorily clean paper pulp in a countercurrent pulp washing operation. This correlation consists of combining the water content per unit area of the pulp mat, as determined by a capacitance measurement, with the drum filter area, rotational speed of the drum and a dilution factor.

Alternative or secondary measurement apparatus may be employed in the washing system either alone or in conjunction with the capacitance measurement apparatus in order to determine other parameters of the washing operation such as consistency of the pulp mat and the production rate of the pulp mat from the washing system. These measurement devices include apparatus to produce and monitor backscattered nuclear radiation and perturbation of microwave cavities. The nuclear radiation measurement apparatus measures the total mass of pulp and water per unit area of the pulp mat.

Microwave cavity perturbation apparatus can be used to determine the liquid content of the pulp mat in place of the capacitance measurement apparatus when the conductivity of the liquid in the pulp mat is a significant factor such as when the conductivity is affected by changes in chemical concentrations in the liquid in the slurry mat. Through the use of microwave cavity perturbation measurement apparatus, changes in the dielectric losses of the liquid in the pulp mat may be separately detected from the remainder of the dielectric properties such as the dielectric constant. The dielectric losses are responsive to the conductivity of the liquid in the pulp mat and are therefore responsive to the efficiency of the shower flow as a wash. The dilution factor and thus the shower flow will be directly responsive to the measured dielectric losses.

The preferred embodiment for accuracy would combine capacitance measurement for the water and nuclear radiation used for the total mass but in some applications the microwave perturbation techniques may be suitable or even superior.

By using the secondary measurement apparatus to determine the total mass per unit area of the pulp mat leaving the washing system, and by using the capacitance measurement apparatus to determine the water mass per unit area, the pulp mass per unit area leaving the washing system may be determined by substracting the water mass per unit area from the total mass per unit area. This determination permits the calculation of the consistency of the pulp mat exiting the washing system as the consistency is the percentage of solids of the total liquid-solid content of the pulp mat. A measure of the consistency of the pulp mat allows the user to evaluate different conditions of drum speed, mat dilution, press roll pressure, anti-foam agents or drainage aids such that the maximum consistency is obtained. The maximum consistency at any given tonnage rate is known to produce the best wash with the least water as shown by the dilution factor and displacement factor. Obviously the highest consistency at a given tonnage rate contains the least amount of water in the sheet and at any given dilution factor the highest consistency also uses the least amount of water to be evaporated. The highest consistency at these conditions will also allow the best wash possible. It is important therefore to be able to quickly and easily determine the consistency of the pulp mat on the filter. Testing for this consistency by present hand sampling methods is very tedious and inaccurate since such a small sample must be taken. The consistency of the pulp mat is continuously monitored by continuously evaluating the pulp mat characteristics as the pulp mat rotates on the filter drum. Capacitance measurements of the pulp mat on the filter drum are preferrably recorded across the entire surface of the filter drum.

BRIEF DESCRIPTION OF THE DRAWINGS

The foregoing objects, features, and advantages of the invention will be more fully understood upon a consideration of the following detailed description of preferred forms of the invention, together with the accompanying drawings, in which.

DESCRIPTION OF THE PREFERRED EMBODIMENTS

Figure 1:
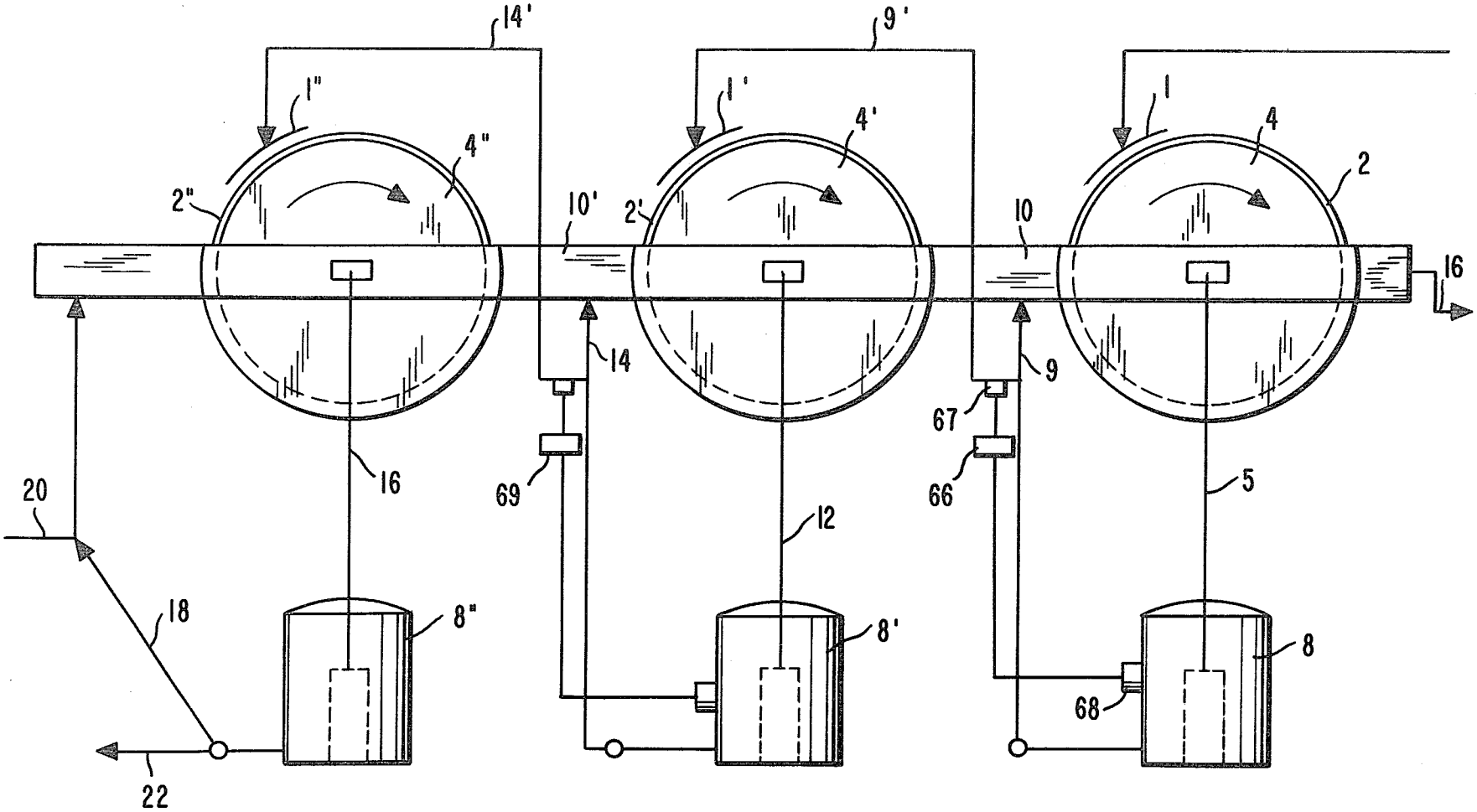
FIG. 1 is a flow schematic of a countercurrent pulp washing operation.

The present invention is applicable to pulp washing operations in general, however, the main embodiment is applicable to the standard countercurrent pulp washing system as demonstrated in FIG. 1. Referring to FIG. 1, the overall countercurrent pulp wash system as displayed in FIG. 1 consists of three rotary drum vacuum filters, 4, 4' and 4'', three filtrate tanks 8, 8', and 8'', two repulpers 10 and 10' and flow lines connecting these individual components in conventional manner.

The pulp and liquor entering this system via a transfer line 20 comes from the digester operation in a wood pulping operation. The amount of water added to the system up to this point is kept to an absolute minimum consistent with good operating procedure in order to maintain the least amount of water that must be evaporated in the subsequent evaporation and chemical recovery system.

The fresh wash water enters the washing system in one location only, through a wash sprayer 1. This fresh water spray through the wash sprayer 1 is hereafter referred to as shower water. The shower water is projected by the wash sprayer 1 onto a pulp mat 2 formed on a tertiary rotary drum vacuum filter 4 which rotates in the direction of the shown arrow. As will be seen, fresh shower water need only be introduced in one location because a countercurrent washing system maximizes the use of water in the system for pulp washing purposes by recycling the filtrate to the previous stages.

Before the pulp mat is subjected to the action of the wash sprayer 1, the pulp mat consists mainly of water supplied from preceeding wash operations, pulp and black liquor. The majority of the water which is contained within the pulp mat formed on the tertiary rotary drum vacuum filter 4 and some of the shower water which is added to the pulp mat by the wash sprayer 1 is drawn from the pulp mat into the tertiary vacuum filter 4 where the water is transferred via a discharge line 5 to a filtrate tank 8. The water which is not removed from the pulp mat 2 by the operation of the vacuum drum filter 4 exits the wash system as a washed pulp mat discharge 16.

The majority of the wash water contained in the filtrate tank 8 is recycled via a transfer line 9 into the intermediate repulper 10 which repulps a pulp mat 2' formed on a secondary vacuum drum filter 4' for feeding onto the tertiary vacuum filter 4. The remainder of the wash water transferred from the filtrate tank 8 is recycled via a transfer line 9' to be used to wash the pulp mat formed on the surface of the secondary vacuum drum filter 4' and is dispensed on the mat 2 via a wash spray 1'. The secondary vacuum drum filter 4' removes most of the water from the pulp mat formed on its surface and transfers the water via a transfer line 12 into a filtrate tank 8'.

Most of the wash water contained in filtrate tank 8' is recycled via a transfer line 14 into the intermediate repulper 10' which repulps the pulp mat formed on a primary vacuum drum filter 4'' for feeding onto the secondary vacuum drum filter 4'. The remainder of the wash water transferred from the filtrate tank 8' is recycled via a transfer line 14' to be used to wash a pulp mat 2'' formed on the surface of the primary vacuum drum filter 4'', and is dispensed on the pulp mat 2'' via the wash sprayer 1''.

The primary vacuum drum filter 4'' removes some of the water from the pulp mat on its surface and transfers this water into the filtrate tank 8'' via a transfer line 16.

Some of the water in the filtrate tank 8'' is added via a transfer line 18 to pulp and liquor supplied via a transfer line 20 from pulp digesters (not shown) for introduction of a pulp slurry into the primary vacuum drum filter 4''. The remainder of the water from the filtrate tank 8'' is transferred to evaporators via a transfer line 22.

Figure 2:
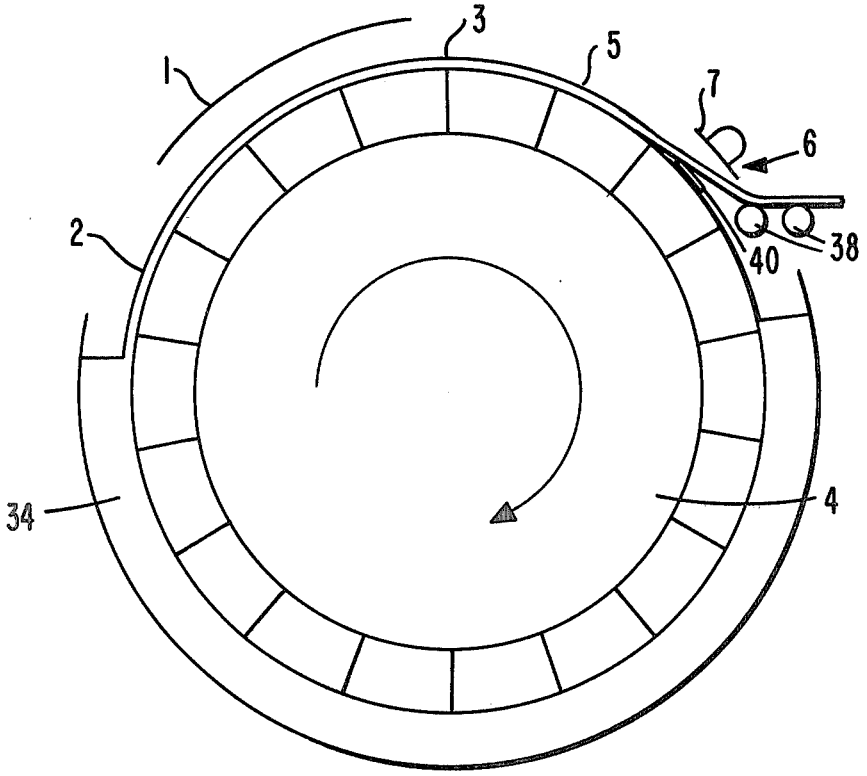
FIG. 2 is an end view of a rotary drum vacuum filter used in conjunction with the pulp washing operation of FIG. 1.
Figure 3:
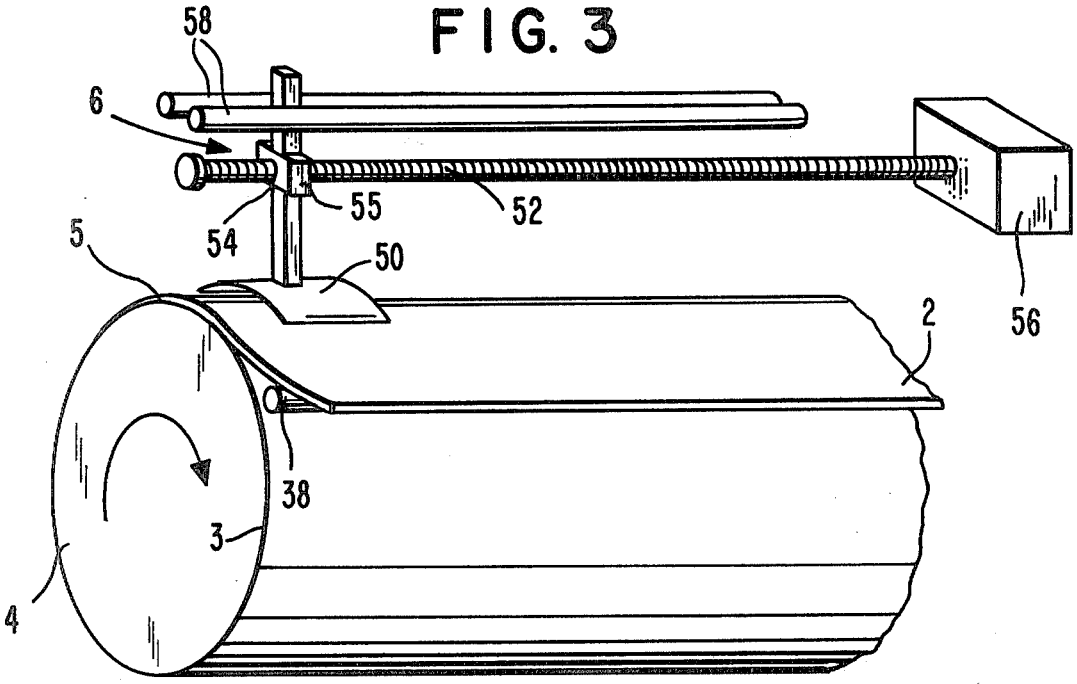
FIG. 3 is a side view of a rotary drum vacuum filter used in conjunction with the pulp washing operation of FIG. 1.
Figure 4:
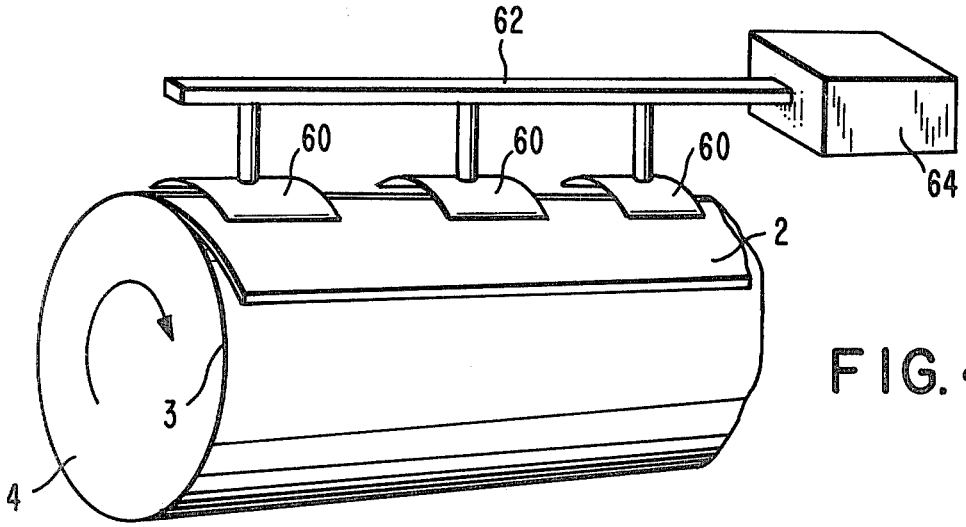
FIG. 4 is a side view of a rotary drum vacuum filter used in conjunction with the pulp washing operation of FIG. 1.

The improvement of the present invention in relation to the countercurrent washing operation as described in FIG. 1, resides in a control apparatus shown in FIGS. 2, 3 and 4 which demonstrate the location of the control apparatus in relation to the rotary drum vacuum filter 4 as used in the washing operation described in FIG. 1.

The countercurrent flow wash system as illustrated in part by the tertiary rotary drum vacuum filter 4 in FIG. 2 shows the entry of fresh shower water into the system via a displacement wash sprayer 1. The fresh water is dispensed by wash sprayer 1 onto the thin pulp mat 2 which is formed from a pulp slurry 34. The pulp mat 2 travels over the exposed surface 3 of a rotary-drum vacuum filter 4 in the direction of the shown arrow. The wash sprayer 1 is designed to apply a uniform application of fresh shower water in order to achieve a high degree of displacement ratio. Wier type showers are sometimes used in place of or in conjunction with spray showers. The water content per unit area of the pulp on the drum filter is measured using a capacitance measurement apparatus 6 as the pulp mat 2 travels over the discharge side of the drum filter 4 and is between a vacuum break 5 and a discharge roller 38.

The capacitance measurement apparatus 6 performs an accurate measurement of the liquid content, that is, the water per square meter in the pulp mat 2 being discharged from the drum filter 4. When the surface 3 of the drum filter 4 is made of metal, the capacitance measurement apparatus may consist of only one live probe 7 using the drum filter surface 3 as the other plate of the capacitance circuit which becomes the grounded electrode. Where the filter drum is not metal, an additional capacitance electrode plate 40 must be stationed between the filter drum surface 3 and the rotating pulp mat 2. The live probe 7 should be spaced from the drum filter surface 3 such that the pulp mat 2 forms a substantial portion of the dielectric medium between the live probe 7 and the grounded electrode.

Capacitance measurement of the water content of the web is used to permit greater immediate control of the washing system. After determining the water content of the pulp mat exiting the washing system, a desired dilution factor is used to adjust the shower flow.

Capacitance measurement is used to determine the water content of the pulp mat for the following reasons. Water has a dielectric constant of 80 at 21° C., paper pulp has a dielectric constant of about 3, and air has a dielectric constant of 1. A pulp mat leaving a washer consists of 85 to 90 percent water and 10 to 15 percent pulp. A capacitance measurement alone at these conditions cannot be used to determine the percentage of pulp or water in the mat even if the mat were freely suspended from the washer drum due to the very low dielectric constant of pulp compared to water. For the same reason a capacitance measurement of a pulp mat containing 85 to 90 percent of water will measure essentially the water alone.

Capacitance measurement of the water content is determined in the following manner. The capacitance is measured using the formula in Equation I:

$$C=0.0886\ KA/t \qquad \text{(I)}$$

where:

C=capacitance in picofarads (pF)

K=dielectric constant of the pulp mat

A=area of plates in square centimeters
t=spacing between plates in centimeters

It is well known that the dielectric constant of water which is the predominant factor effecting the dielectric constant of the pulp web, is variable with temperature. The dielectric constant of water at 100° C. is 55.33 and increases to 88.00 at 0° C.

This effect is compensated by temperature measurement of the pulp mat in the system. In most pulp washing processes the temperature of the washing water is held fairly constant and will not require a measurement of the temperature in the pulp mat itself. A normal temperature for the shower water is about 65° C. At a dilution factor exceeding 1.0, the temperature of the water in the mat is very nearly 65° C. A variation of 5° C. in the temperature of the water in the mat would produce an error of 2.3 percent in the measured amount of water in the mat. In instances where the water in the pulp mat has this degree of variability, the temperature should be constantly measured and the dielectric constant must be determined for use in Equation I.

A preselected frequency will be used in measuring the capacitance, however, the use of multiple frequencies for more accurate determination of the water content is possible and could be done in systems requiring greater accuracy than single frequency determinations.

Once the capacitance is determined, the water content in the discharging pulp mat as herein expressed in the terms liters of water per square meter of pulp mat may be expressed by Equation II.

$$L=CF \qquad \text{(II)}$$

where:
L=liters of water per square meter
C=capacitance of pulp mat in picofarads (pF)
F=cell factor The cell factor F of the capacitor predetermined by a calibration test using Equation IIA:

$$F=B/V \qquad \text{(IIA)}$$

where:
V=meter reading in picofarads when a prepared sample is in the capacitor
B=water content of the prepared sample above in liters per square meter.

This calibration of the capacitor and determination of the cell factor is performed by measuring the capacitance of air in the capacitance measuring apparatus and subsequently measuring the capacitance of a prepared sample of pulp mixed with water in a known proportion.

After determining the liquid content L, the set point for the shower water flow on the washer may be calculated by Equation III with the variables expressed in appropriate units:

$$S=(L)(R)(A)(D) \qquad \text{(III)}$$

where:
S=shower flow set point (liters/minute)
L=liters of water per square meter
R=revolutions of the filter drum per minute
A=area of drum face surface in square meters
D=dilution factor In the use of Equation III it should be noted that the area A of the filter drum surface 3 is completely covered with pulp mat as the drum makes one complete revolution and thus represents the area of pulp mat on the surface of the filter drum.

The capacitance measurement apparatus 6 is shown in alternative forms in FIG. 3 and FIG. 4.

In FIG. 3 the live capacitance plate 50 mechanically tranverses across the surface of the pulp mat 2. The transverse movement of the live plate 50 is performed by the rotation of a screw bar 52 through a threaded opening 54 in a plate assembly 55. The screw bar is rotated by a reversible electric motor 56. The plate assembly 55 is held in a vertical position through the use of a pair of guide rods 58. The live plate 50 transverses back and forth across the pulp mat on the drum filter 4 measuring the capacitance of the pump mat 2 using the metallic surface of the drum filter 4 as the grounded electrode while moving the transversing live capacitance plate 50 remains at the same relative distance between the vacuum break 5 and the pulp mat discharge on roller 38. The function of the transversing live plate 50 is to obtain capacitance readings along the entire width of the pulp mat.

In FIG. 4, a series of stationary live capacitance plates 60 are used to measure the capacitance along the width of a pulp mat 2 which rotates with the drum filter 4 and the metallic surface 3 of the filter drum acts as the grounded electrode. The plates 60 are located on a support 62 and controlled by an electrical switching device 64 which can activate any one of the individual plates 60 or any combination of the plates 60 to record either the capacitance at an individual plate position or take an average capacitance reading from two or more of the plates when a plurality of plates are activated.

The capacitance measurement apparatus has heretofore been illustrated as being located only on the tertiary drum filter 4 in the series of filter drums which are used in the countercurrent washing operation as shown in FIG. 1. However, it is obvious to one skilled in the art that it is advantageous to control the shower flow on all of the filter drums to increase the efficiency of the overall wash system. As represented in FIG. 1, it is noted that the flow of liquid dispensed from the filtrate tank 8 via the transfer lines 9 and 9' is equal to the input into the filtrate tank 8 via the transfer line 5 from the tertiary drum filter 4. The level of liquid in the filtrate tank 8 must remain constant or the wash system will either overflow liquid from the filtrate tank 8 or stop due to a shortage of liquid supply to the transfer lines 9 and 9' from the filtrate tank 8. Since the filtrate tank 8 contains a large capacity of liquid compared to the flow through the wash sprayer 1' it is practical to regulate the liquid flow through the wash sprayer 1' onto the pulp mat 2' formed on the secondary rotary drum vacuum filter 4' through the use of the same capacitance measurement technique as is used on the tertiary rotary drum vacuum filter 4. One problem which arises in using the same capacitance measurement technique is that a slight change in conditions such as pulp consistency in the washing operations will cause a net gain or loss in the liquid level in the filtrate tank 8. This problem is overcome through the use of an additional dilution control system 66 as shown in FIG. 1 which slowly alters the dilution factor up or down to maintain a constant liquid level in the filtrate tank 8. The dilution control system 66 may consist of a flow regulator 67 which is responsive to a liquid level sensor 68 which records the level of the liquid in the filtrate tank 8 and correspondingly adjusts the flow rate of liquid to the wash sprayer 1'.

The shower flow through the wash sprayer 1" on the primary rotary drum vacuum filter 4" is controlled in the same manner using a dilution control system 69 to regulate the liquid level in the filtrate tank 8'.

These combined methods of controlling the shower flow from the wash sprayers 1, 1' and 1" onto their respective pulp mats 2,2' and 2" produces additional benefits in efficiency over excercising a control of the shower flow from the wash sprayer 1 alone in that a short term excessive wash will not compensate for an equal term of underwash in a previous washing stage. Neither the control of the shower flow nor the control of the liquid level in the filtrate tank either alone or in combination can be used to control the dilution factor without the capacitance measurements proposed herein. Additionally, through the use of the dilution control systems 66 and 69 in the countercurrent pulp washing operation an added benefit is obtained in the early detection of faulty equipment as filtrate tank levels will be responsive to abnormal deviations in the washing operation.

While the use of capacitance measurement apparatus appears to be the most accurate method of measuring the water content per unit area of the pulp mat on the filter drum, alternative systems may be used either alone or in combination with the capacitance measuring apparatus.

Figure 5:
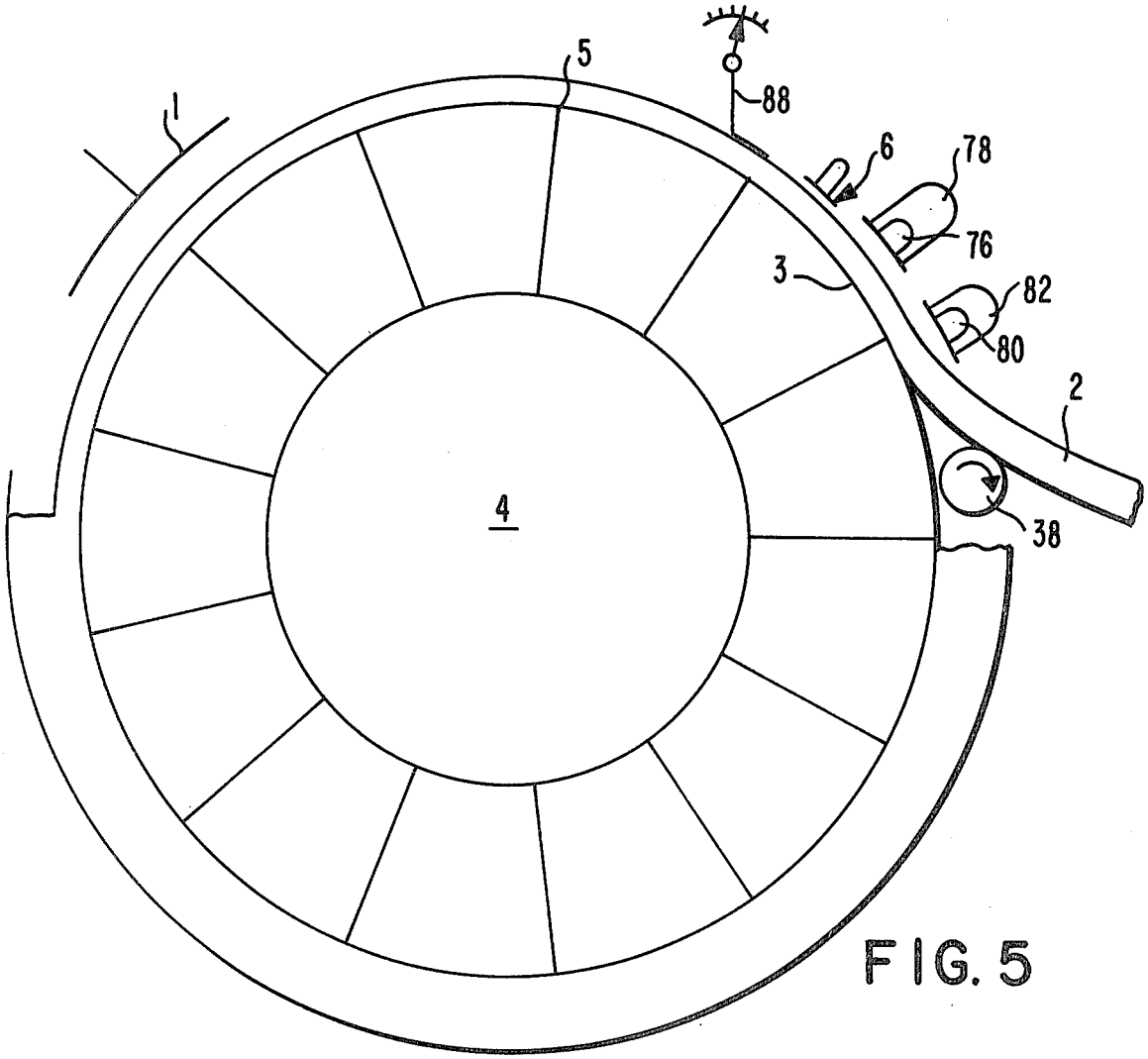
FIG. 5 is the end view of a rotary drum vacuum filter used in conjunction with the pulp washing operation of FIG. 1.

The first alternative system is shown in FIG. 5. A radiation source 76 transmits radiation which passes through the pulp mat 2 and strikes the metallic surface 3 of the filter drum 4 whereby radiation is reflected and detected by a radiation detector 78. This system will measure the total mass per unit area of the pulp mat and is located in a position to monitor the pulp mat 2 after the pulp mat rotates on the filter drum 4 over the vacuum break 5. In some cases this backscatter nuclear radiation device can be used alone and will give a better control than previously used since only the consistency need be estimated rather than an estimated rate determined from the first washer feed rate along with the consistency.

The second alternative system is essentially the same as the nuclear radiation system except that the nuclear source 76 is replaced with a microwave source 80 and the radiation detector 78 is replaced with a microwave sensor 82. With very sophisticated equipment and scanning microwave frequencies it is possible to determine both the dielectric losses and the water per unit area with this system.

The function of shower water control is so important that it may be desirable to use the capacitance measurement apparatus in conjunction with one of the alternative embodiments. The capacitance measurement is used to determine the water content per unit area in the pulp web and the radiation absorption measurement techniques can determine the total mass of the pulp mat per unit area.

Through the combined use of the measurements as calculated from capacitance measurement apparatus and from either radiation or microwave absorption measurement apparatus, the following parameters of a pulp wash system may be calculated from their respective determination equations.

Equation IV may be used to calculate the dry pulp mass per unit area in the pulp mat employing both the total mass of pulp and water per unit area, as determined by radiation measurement techniques and the mass of water per unit area of the pulp mat as determined by capacitance measurement:

$$P=M-LG \qquad \text{(IV)}$$

where:

P=kilograms of pulp per square meter of pulp mat
M=kilograms of pulp and water per square meter of pulp mat
L=liters of water per square meter of pulp mat
G=specific gravity of water at existing conditions such as the temperature of the pulp mat The pulp production rate of a pulp washing system is determined by Equation V:

$$Q=1.44(P)(R)(A) \qquad \text{(V)}$$

where:

Q=pulp production rate in metric tons per day
P=kilograms of pulp per square meter of pulp mat
R=revolutions per minute of filter drum
A=area of surface of filter drum in square meters The consistency or the percentage of pulp in the mixture of pulp and water leaving the wash system in the form of a pulp mat is calculated by equation VI:

$$N=100P/M \qquad \text{(VI)}$$

where:

N=consistency of pulp mat expressed in percentage
P=kilograms of dry pulp per square meter of pulp mat
M=kilograms of pulp and water per square meter of pulp mat Conventional thickness measuring apparatus may be employed in a pulp washing system as demonstrated by thickness measuring device 88 in FIG. 5 which determines the pulp mat thickness at a point between the vacuum break 5 and roller discharge 38. The air content of the mat may be determined by Equation VII through the use of the combined measurements of the apparatus demonstrated in FIG. 5. The percentage of air entrained in the pulp effects the displacement factor.

$$U=100-10(L+(P/G))/T \qquad \text{(VII)}$$

where:

U=percentage of air in pulp mat
L=liters of water per square meter of pulp mat
P=kilograms of dry pulp per square meter of pulp mat
G=specific gravity of cellulose
T=thickness of pulp mat in centimeters Some pulp washing systems employ chemical additives to improve the overall washing operation. These additives perform a variety of functions such as prevention of foaming and air entrainment in the pulp slurry and include anti-foam agents, drainage aids and washing aids. The measurement and determination of the pulp consistency and the air content of the pulp mat can be used to minimize the amount of the above-identified additives which are added to the washing operation.

While the present invention has been described in the context of a basic brown stock pulp washing operation for washing cellulose, it may be applied to a variety of operations such as a bleach plant washing step. The liquid dispensed from the wash sprayers may be water, recycled water or chemical treating agents. The control system is applicable to systems which treat slurries of materials other than pulp such as lime mud feed to kilns or calciners.

It is, of course, understood that the foregoing description of the process of the present invention is intended to be illustrative and that modifications thereof as would be apparent to one skilled in the art are deemed to fall within the scope and spriit of the present invention as defined by the following claims.

I claim:

1. A process for controlling the flow rate of a liquid shower for a desired dilution factor in a countercurrent pulp washing operation in which the shower is applied to a slurry mat consisting of a mixture of a liquid and a solid material which rotates on the surface of a rotary drum vacuum filter wherein the liquid content per unit area of the slurry mat is determined by directly measuring the dielectric properties of the slurry mat after it has passed over a vacuum break and before it is discharged from the vacuum filter and the flow rate of the liquid shower is controlled in relation to said measured liquid content per unit area of the slurry mat with the surface area and the rotational speed of the rotary drum vacuum filter and said dilution factor.

2. A process as defined in claim 1 wherein the slurry mat is a cellulose pulp mat consisting of a mixture of pulp and water.

3. A process as defined in claim 1 wherein the washing operation is a brown stock washing operation.

4. A process as defined in claim 1 wherein the washing operation is a bleach plant washing operation.

5. A process as defined in claim 1 wherein the flow rate of the liquid shower is controlled in each of a plurality of washing operations on the drum filters in a countercurrent washing system.

6. A process as defined in claim 1 wherein the liquid shower is fresh water.

7. A process as defined in claim 1 wherein the liquid shower is recycled wash water.

8. A process as defined in claim 1 wherein a measurement of the liquid content per unit area of the slurry mat is obtained by a capacitance measurement apparatus which measures the dielectric properties of the slurry mat after the slurry mat rotates over a vacuum break in the filter drum and before the slurry mat is discharged from the filter drum wherein the measurement of the liquid content per unit area of the slurry mat is determined in accordance with the following equation:

$$L=CF$$

where:

L=content of liquid per unit area of the slurry mat

C=capacitance of the slurry mat

F=cell factor of the capacitance measurement apparatus.

9. A process as defined in claim 8 wherein a production rate of the solid material in the slurry mat and a consistency of the slurry mat is determined from a correlation of the liquid content per unit area of the slurry mat and a combined liquid and solid material content per unit area of the slurry mat on the drum filter as measured by a total mass measurement apparatus.

10. A process as defined in claim 9 wherein the total mass measurement apparatus consists of at least a backscattered nuclear radiation apparatus.

11. A process as defined in claim 9 wherein the total mass measurement apparatus consists of at least a microwave cavity perturbation apparatus.

12. A process as defined in claim 9 wherein a means for measuring a thickness of the slurry mat is used in addition to the dielectric properties measurement apparatus and the total mass measurement apparatus in order to determine an air content of the slurry mat.

13. A process as defined in claim 1 wherein the liquid shower is supplied from a filtrate tank and the dilution factor is responsive to a liquid level in the filtrate tank.

14. A process as defined in claim 1 wherein the dilution factor is adjusted to be responsive to dielectric losses in the slurry mat.

* * * * *